United States Patent [19]

Chigusa et al.

[11] Patent Number: 4,848,321

[45] Date of Patent: Jul. 18, 1989

[54] METHOD FOR THE PROGRAM CONTROL OF A PAN

[75] Inventors: Takehiko Chigusa, Tokyo; Hitoshi Hashimotor, Yokohama; Tsunenori Kawamura, Yokohama; Kazunori Fukushima, Yokohama; Kiyoumi Kurokawa, Yokohama; Masakatsu Miyazaki, Yokohama, all of Japan

[73] Assignees: Yokogawa Electric Corporation, Tokyo; Ensuiko Sugar Refining Co., Ltd., Yokohama, both of Japan

[21] Appl. No.: 272,438

[22] Filed: Nov. 17, 1988

Related U.S. Application Data

[63] Continuation-in-part of Ser. No. 225,633, Jul. 27, 1988, abandoned, which is a continuation of Ser. No. 33,865, Apr. 4, 1987, abandoned, which is a continuation of Ser. No. 751,245, Jul. 2, 1985, abandoned.

[30] Foreign Application Priority Data

Jul. 3, 1984 [JP] Japan ..... 59-137439

[51] Int. Cl.[4] ..... C13F 1/00; C13F 1/12

[52] U.S. Cl. ..... 127/61; 127/60; 127/58; 127/62

[58] Field of Search ..... 127/61, 60, 58, 62

[56] References Cited

U.S. PATENT DOCUMENTS

| | | | |
|---|---|---|---|
| 3,554,800 | 1/1971 | Javet et al. | 127/61 |
| 4,056,364 | 11/1977 | Dmitrovsky et al. | 127/60 |
| 4,155,774 | 5/1979 | Randolph | 127/62 |

FOREIGN PATENT DOCUMENTS

| | | | |
|---|---|---|---|
| 12279 | 3/1984 | Japan | 127/60 |

*Primary Examiner*—H. M. S. Sneed
*Assistant Examiner*—Chung K. Pak
*Attorney, Agent, or Firm*—Moonray Kojima

[57] ABSTRACT

In the field of automatic boiling in a pan in which the consistency of massecuite is controlled in accordance with method steps, intermittent boiling is used as an effective way to improve the boiling time and quality of products with supplying of appropriate amounts of water or solution into the pan to control the consistency each time it has reached a set value. This invention provides a novel method for controlling the consistency of the massecuite, wherein two curves are established defining the upper limit and lower limit, respectively, of an allowable range of consistency and within which the consistency is maintained, whereby a product of high quality is obtained safely, simply and within a minimum amount of time.

2 Claims, 4 Drawing Sheets

METHOD FOR THE PROGRAM CONTROL OF A PAN

RELATED APPLICATIONS

This is a continuation-in-part of Ser. No. 07/225,633 filed 7/27/88, which was a continuation of Ser. No. 07/033,865 filed 4/4/87, which was a continuation of Ser. No. 06/751,245 filed 7/2/85, all of which are now abandoned.

BACKGROUND OF THE INVENTION

1. Field of Invention

This invention relates to a method of controlling the consistency of massecuite in an automatic boiling apparatus in a pan.

2. Description of the Prior Art

FIG. 1 depicts a conventional vacuum boiling apparatus, comprising a parallel side pan 1 having a calandria type heating area 2. The solution F (e.g. syrup used to prepare sugar), to be boiled, is supplied into the bottom of pan 1 through a solution control valve 3, Heating steam S is supplied to heating area 2 through a control valve 4 to heat and concentrate the solution by vaporization. The solution continues to be supplied until a concentration enabling crystallization is reached. Then, a seed is added from a feeder 5 through a valve 6 to form appropriate nuclear grains.

While the interior of pan 1 is observed, such as through windows 10, water W or solution F is supplied to avoid bonding of the nuclear grains and formation of undesirable nuclear grains (false grains), so that the concentration of the solution and the growing of crystals may be continued. If crystals grow to a certain extent, false grains are less likely to form, since the crystals occupy a certain volume in a unit volume of messecuite (defined as a mixture of solution and crystals) and are located relatively close to one another. The solution is further concentrated to facilitate growth of crystals. Solution F is added to increase its volume in the pan 1, to a certain level. When a predetermined crystal size has been obtained, the massecuite 7 is discharged through a discharge valve 8.

The massecuite is separated by a centrifugal separator into the crystals and the solution. The solution is then recycled for boiling. In order to control the concentration of the massecuite appropriately during boiling, it is possible to supply pan 1 with water W or solution F through a water control valve 9 or solution control valve 3. Of course if necessary or desired suitable amounts of both may be concurrently supplied. It is possible to observe the interior of pan 1 through peep windows 10. Steam is drawn out from pan 1 into a condenser 11 by a vacuum pump 13 which is connected to condenser 11 through a valve 12. Condenser 11 is cooled by cooling water W which is supplied through valve 14.

Various methods have been proposed for controlling the pan, but the usual method used now is to use an intermittent boiling method which increases the consistency of massecuite in accordance with a control method comprising a specific program of steps and thereby attains stability of operation. One such method is disclosed in Japanese Laid Open Pat. No. 41248/1977.

Returning to FIG. 1, a signal $e_m$, indicating the consistency of massecuite, is transmitted from a consistency meter 15, such as a rheometer, to control portion 161 of a sequence control system 16. The control system 16 also includes a program setting system 162 for feeding a set value $e_s$ of of a particular consistency desired to the control portion 161, and a valve actuator 163 for opening or closing solution control valve 3 and/or water control valve 9 in accordance with the output of the control portion 161.

A level gauge for the determining of the level of the massecuite 7 in pan 1, a pressure control device for maintaining an appropriate vacuum degree in pan 1, etc, are also provided, although not shown in FIG 1.

A conventional method of the program control of the boiling operation, such as of the system of FIG. 1, is depicted in FIGS. 7A, 7B. FIG. 7A shows changes in the measured value $e_m$ and set value $e_s$ of consistency in a specific area of the crystal growing process in which the solution is boiled. FIG. 7B depicts the operation of the solution control valve 3 at different times.

At time $t_1$, when measured value $e_m$ has increased to the level $m_1$ of set value $e_s$, solution F is supplied to pan 1 to control, such as by loosening, the consistency of massacuite. The next level $m_2$ of the set value $e_s$ is higher than the level $m_1$ by $\Delta m$. When the value $e_m$ has increased to level $m_2$, solution F is supplied again at time $t_2$. The same is repeated at time $t_3$, time $t_4$, etc. A broken line C, which is obtained by connecting the peak values of $e_m$, defines the ideal limit curve for the control of consistency. If the consistency of the massecuite is controlled in accordance with curve C, it is possible to complete a batch of operation in a minimum amount of time, while maintaining the high quality of crystals.

The ideal curve C can, however, be maintained only when various parameters, such as the amount of steam in the pan, its vacuum degree and purity of solution, are maintained at suitable levels. It is difficult to maintain any such ideal pattern of control if one or more of the parameters change, for example, if the amount of steam S in the pan or its vacuum degree has substantially changed.

For example, if the amount of steam has been reduced abnormally after time $t_4$, a long time is required for value $e_m$ of consistency to reach the set value $e_s$ at $m_5$. Thus, if the same pattern of control is continued, the value of consistency changes to $e_m'$, as shown in FIG. 7A. A curve C', which is obtained by connecting the peak values of $e_m'$, has a lower gradient than curve C and largely deviates therefrom. If boiling is continued under these circumstances, a prolonged time is required for a batch of operation to be completed, and it is difficult to obtain crystals of good quality, since false grains are likely to form.

In another example, as shown in FIG. 7A, an abnormal increase in the amount of steam after time $t_4$ gives rise to a phenomenon contrary to what has been above described. The value of consistency changes to $e_m''$. A curve C'', which is obtained by joining the peak values of $e_m''$, has a higher gradient than curve C and largely deviates therefrom. A batch of operation is completed abnormally rapidly resulting in the production of defective products containing a large amount of false grains.

SUMMARY OF INVENTION

Accordingly, an object of the invention is to overcome the aforementioned and other deficiencies and disadvantages of the prior art.

In controlling consistency of massecuite, the inventors have found that it is advisable to establish an ideal curve (an upper limit curve) obtained by joining the peak values of consistency for enabling operation within a minimum time without the formation of false grains and a permissible limit curve (lower limit curve) by taking into account any possible changes in parameters and having a lower gradient than the ideal curve.

To do this, it is necessary to determined the speed of crystallization in relation to the speed at which solute molecules form germs (also known as embryos). Thus, in order to grow crystals without the formation of false grains, it is necessary to supply solution or water to the pan to destroy tghe germs beform new false grains grow from the germs. This is one characteristic of intermittent boiling.

The following formula is known as giving the number of germs.

$$n_c = \sqrt{\frac{8m}{\pi kT}}\, x_c^2 N^2 \nu Ac \left( \sqrt{\frac{2E_c}{m}} - C \right)$$

wherein $n_c$=number of germs which grow in a unit time.

m=mass of a solute molecule.

$\pi$=constant.(i.e. 3.1416 etc)

k=Boltzmann's constant

T=absolute temperature.

$x_c$=distance between points c (peak values) of gravity between molecules.

N=number of solute molecules per unit volume.

$\overline{V}$=average velocity of movement of solute and solvent molecules.

A=a constant of about 0.4. (see derivation below) **

C=upper limit of speed at which molecules are caught by crystals.

$E_c$=gravity of distance $x_c$ in the interaction of grains.

** The constant of about 0.4 for A is derived as follows:

A=constant ($A=\Phi(a)\approx 0.4$ when $a<1$)

$$\Phi(a) = \frac{1}{2\pi}\int_0^a \exp\left(-\frac{t^2}{2}\right)dt, \approx \{1-\exp(-0.9a)\}/2$$

where t is time;

wherein $$a = \sqrt{\frac{2E_c\, m_l}{\pi kTm}} < 1.,$$

where mγ is the average mass of a solute molecule. Therefore, $A=\Phi(a)\approx 0.4$ a constant.

As is apparent from the above formula, if the number of solute molecules (purity) N is given, the number of germs growing per unit time and hence the speed of crystal precipitation and growth are proportional to $N^2$. Thus, there exists a speed of crystallization, for example, specific to a particular kind of sugar (depending on the crystal size and the solution) when ideal conditions covering the apparatus, amounts of solute and steam, and other parameters exist.

This speed of crystal growth under ideal conditions is expressed by an upper limit curve for consistency if a sensor (consistency meter) is used for detecting the ratio of crystallization and the factors dictating the growth of crystals from the solution (its concentration, supersaturation, etc).

As a matter of fact, however, it is necessary to adjust the boiling time in view of changes in the purity of the solution, the amount of steam, etc. This adjustment can be realized with a control method having steps to maintain the set values at a specific set of levels.

In the event the solution is low in purity, or the amount of steam is reduced, it is necessary to set at higher levels, the factors dictating the growth of crystals which are detected by the consistency meter. These values define a lower limit curve for consistency.

When the concepts of upper limit curve (ideal) and lower limit curve (permissible) are introduced into a control method to control the consistency of the massecuite, it is possible to cope adequately with any variation resulting in the limit curves from disorder in the surrounding conditions or the correlation between the speeds of crystal growth in the massecuite and its concentration and thereby realize stabilized control of boiling operation.

It is another object to provide a control method which does not cause any substantial deviation from an ideal limit curve even if any disorder may develope in the surrounding conditions.

These and other objects are attained by a method which comprises the steps of establishing curves defining the upper and lower limits of an allowable range of consistency of the massecuite and starting from each point at which the measured value of consistency coincides with a set value, increasing the set value along the curve defining the upper limit, holding the set value when it has been increased to a specific degree, or when a specific length of time has passed, and increasing the set value along the curve defining the lower limit after a line representing the set value has crossed the curve defining the lower limit.

A further object is to provide a control method which uses practical means for the approximate establishment of curves defining the upper and lower limits of an allowable range of consistency.

These and other objects are attained by a method in which at least a curve defining the lower limit of an allowable range of consistency is approximately a straight line having a gradient which is determined by a simple algorithm.

DETAILED DESCRIPTION OF PREFERRED EMBODIMENTS

Figure 1:
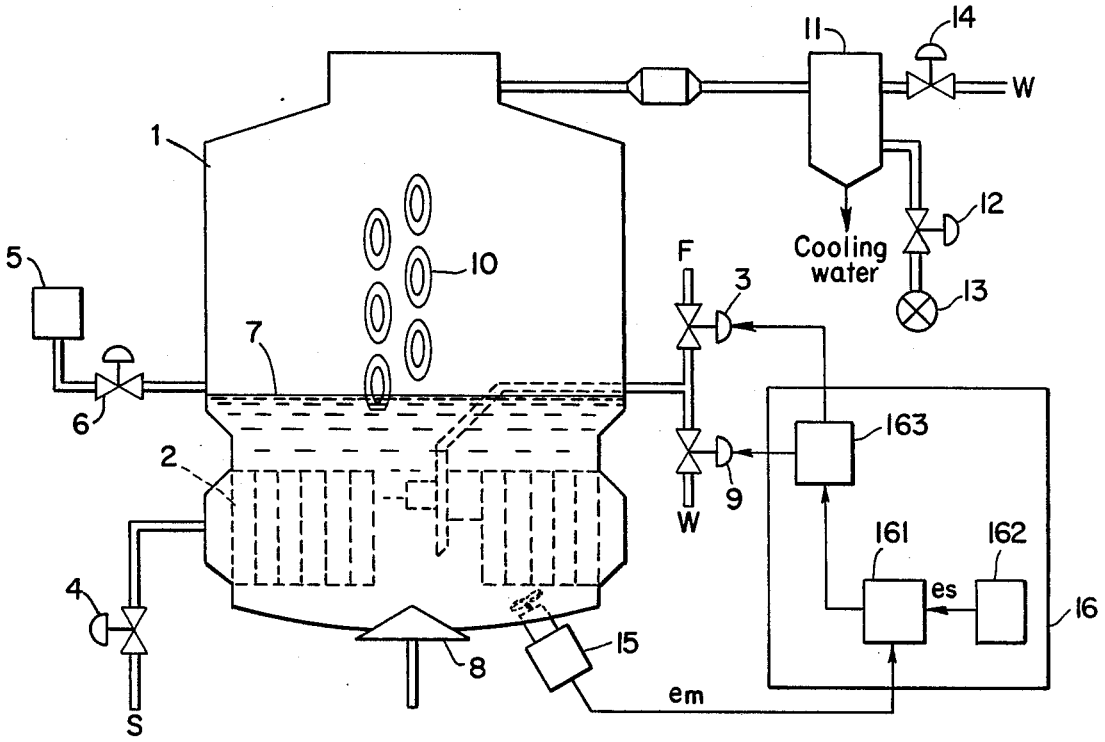
Fig.1 PRIOR ART
FIG. 1 is a diagrammatic view depicting a conventional boiling apparatus, including a crystallization pan.

In the following description of the methods of the invention, the methods are applied to enable the control system to control the boiling operation of the apparatus, such as shown in FIG. 1. The control system, and its components are known in the art. The method of control disclosed and claimed herein, however, is novel and produces the outstanding results and advantages herein discussed.

Figure 2A:
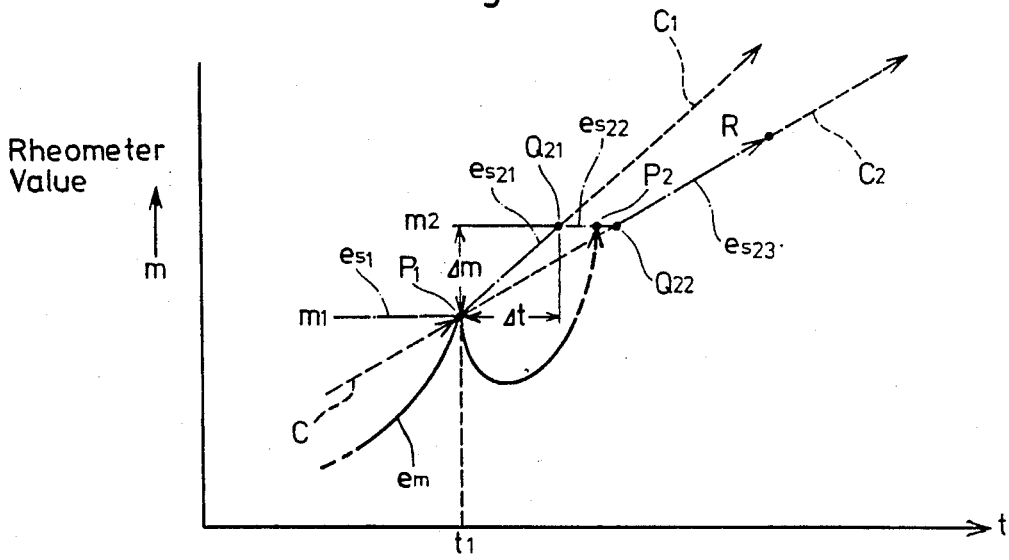
FIGS. 2A, 2B are graphical representations of a method illustrative of the invention.
Figure 2B:
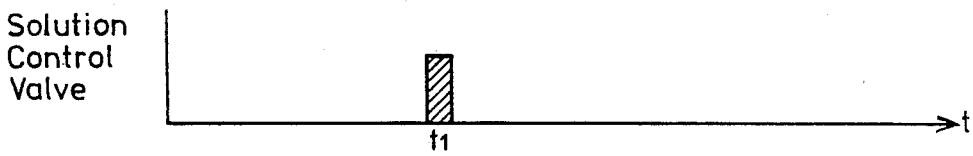

Turning now to FIGS. 2A,2B which describe graphically and representationally the method of the invention, there is depicted in FIG. 2A, measured value $e_m$ of consistency is shown by way of example as having reached level $m_1$ of a set value $e_s$ at time $t_1$. measured value $e_m$ has a peak $P_1$. The inventorsknow from experience that no single curve is sufficient to define the consistency of the massecuite, but that there exists a specific range in which the peak value of consistency changes from one point to another. This range is shown as a region R defined by and between two curves, both starting from the point $P_1$, that is a curve $C_1$ defining the upper limit of the range (upper limit curve) and a curve $C_2$ defining the lower limit (lower limit curve). It was discovered that strictly speaking, there exists a pair of optimum upper and lower limit curves starting from each peak. Accordingly, it is possible to maintain the measured value $e_m$ of consistency within the allowable range R throughout the boiling operation by reading out of a memory, such as in the control system 16 depicted in FIG. 1, two defined curves starting from a particular level of the set value of massecuite consistency and varying the set value to another level in accordance with those curves so that another peak of the value $e_m$ may be maintained within a range R.

The control or definition of set values $e_s$ will now be described in further detail. If the value of $e_m$ reaches at $P_1$ the value $e_{s1}$ (consistency level $m_1$) set for a particular cycle of boiling operation, two curves $C_1$ and $C_2$ starting from point $P_1$ (time $t_1$, consistency level $m_1$) are defined by broken lines as shown in FIG. 2A. The set value of consistency for another cycle of boiling operation is defined by a curve $e_{s21}$ coinciding with curve $C_1$ as shown by a one dot chain line and representing a proportional increase in consistency with the lapse of time. When the set value has been increased to a specific degree from point $P_1$ as shown $\Delta m$, or when a specific length of time has passed as shown by $\Delta t$, it is maintained at a constant level $m_2$ of consistency after point $Q_{21}$ on curve $e_{s21}$ as shown by a horizontal line $e_{s22}$. With the lapse of further time, line $e_{s22}$ meets the lower limit curve $C_2$ at point $Q_{22}$, and the set value is thereafter defined by a curve $e_{s23}$ coinciding with curve $C_2$ and increase in proportion to time. The values of $\Delta m$ and $\Delta t$, which determine points $Q_{21}$ and $Q_{22}$, are selected based on experience so that the point at which the value of $e_m$ is expected to reach another peak $P_2$ may fall on the line $e_{s22}$ between points $Q_{21}$ and $Q_{22}$.

Figure 7A:
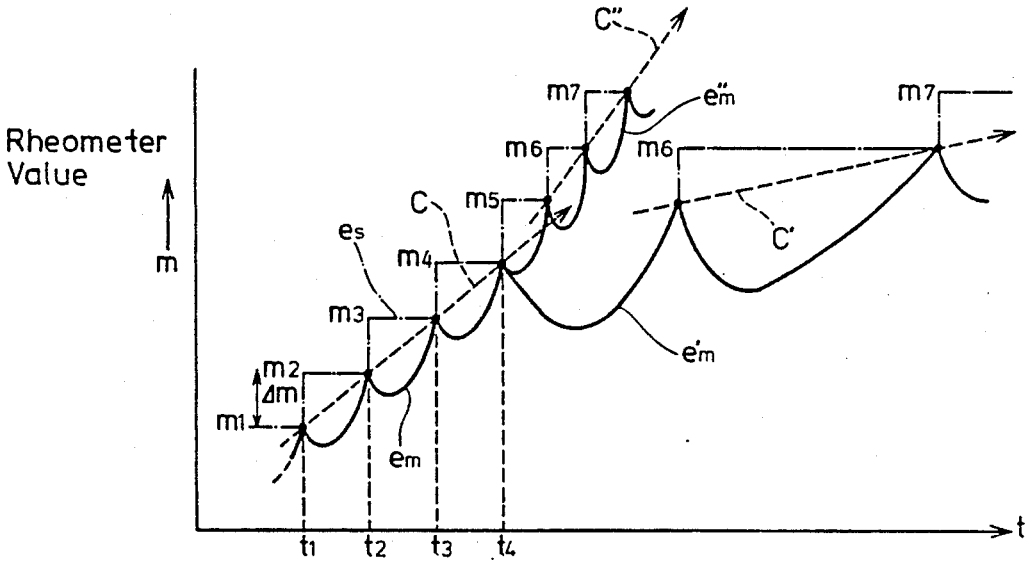
Fig.7A PRIOR ART
FIGS. 7A, 7B are graphical representations of a conventional method of controlling the boiling operation.
Figure 7B:
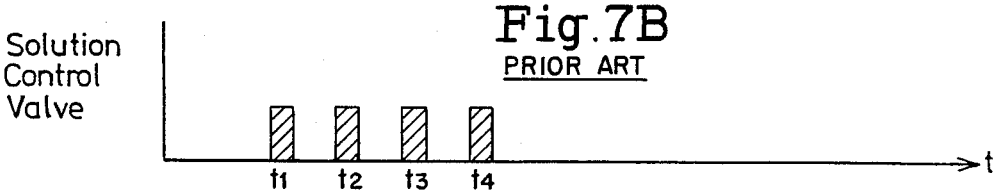
Fig.7B PRIOR ART

The method steps are determined to define a pair of limit curves starting from each peak of the value $e_m$ substantially as above described. It enables the achievement of the results of control at least comparable to and in fact substantially better than those obtained with any conventional control curve, since all of the peaks $P_1$, $P_2$ . . . of the value $e_m$ fall within the respective ranges R unless there is a disorder in the parameters dictating the boiling operation in the pan. The shift of the peak value of consistency from $P_1$ to $P_2$ is equivalent to the shift from $m_1$ to $m_2$ in FIG. 7A.

If there is any disorder of the parameters occuring during boiling operation, it is possible that the peak $P_2$ may appear earlier than at point $Q_{21}$, and not fall on the horizontal line $e_{s22}$. The consistency is, however, so established as to increase in proportion to time along the curve $e_{s21}$ which coincides with curve $C_1$, and which represents smaller values than $m_2$. Thus, the value $e_m$ and hence the peak $P_2$ thereof are kept from rising above the upper limit defined by curve $C_1$.

If the peak $P_2$ does not fall on line $e_{s22}$, but appears later than at point $Q_{22}$, the value $e_m$ is kept from rising above the lower limit defined by curve $C_2$ above point $Q_{22}$ and the peak $P_2$ is correspondingly increased, since the consistency is so defined as to increase in proportion to time along curve $e_{s23}$ which coincides with curve $C_2$ and which represents larger values than $m_2$ at $Q_{22}$.

Insofar as even in case any disorder occurs to any of the parameters, the peak of value $e_m$ is so corrected as to fall on the horizontal line $e_{s22}$ and maintianed at least on the upper or lower limit curve, as above set forth, it is possible to maintian the value $e_m$ of consistency within the allowable range R throughout each cycle of boiling operation, for example of the apparatus of FIG. 1, and thereby improve greatly any serious variation in boiling time and the production of defective products which prior to the invention had been unavoidable.

According to the invention, it is necessary to establish two limit curves starting from each peak of value $e_m$ and a somewhat complicated algorithm is required for establishing these curves, depending on the position of the peak. They are, however, relatively easy to establish if a control apparatus, including a computer, is used to combine empirical data on the curves with a modified algorithm based on the shift of the peak.

Figure 3A:
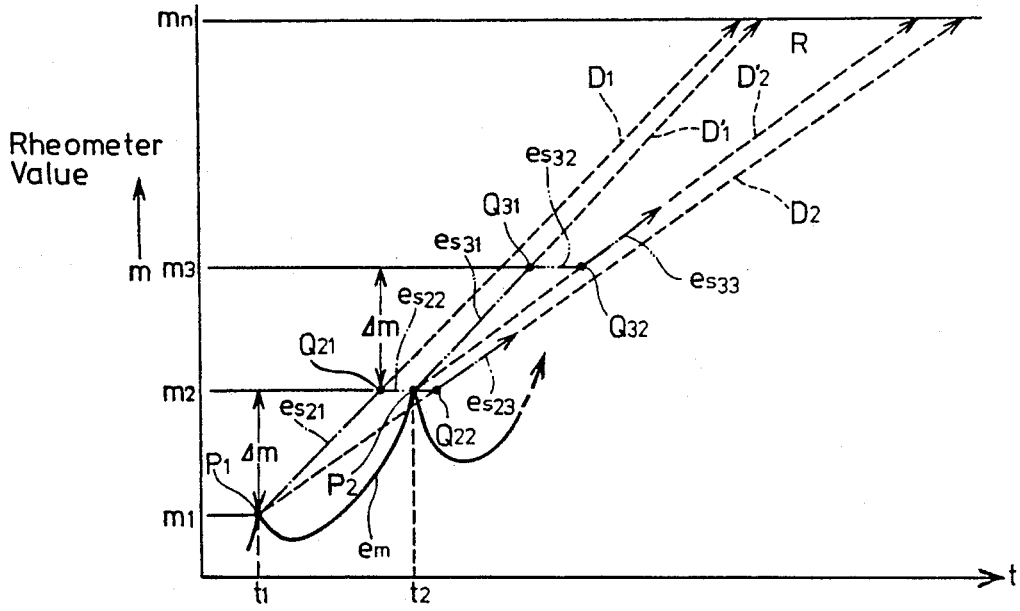
FIGS. 3A, 3B are graphical representations of another illustrative embodiment.
Figure 3B:
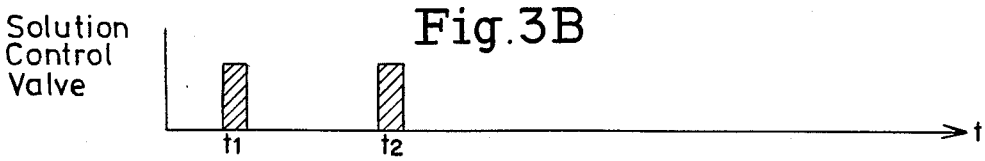

Another embodiment of the invention, which simplifies the algorithm, is shown representationally in FIGS. 3A, 3B. This method can be effectively used to establish a set of steps without affecting the advantages of the invention. The area in which boiling is carried out is appropriately divided into a plurality of regions. The initial value of the massecuite consistency in a particular region is shown at $m_1$, and its final value of $m_n$. If the consistency of massecuite reaches $m_1$ at time $t_1$, there are established two straight lines $D_1$ and $D_2$ starting from the peak $P_1$ defined by $t_1$ and $m_1$, and defining an allowable range R therebetween. The set value after time $t_1$ is given by a one dot chain line $e_{s21}$ coinciding with the upper limit line $D_1$ until it increases by $\Delta m$ to $m_2$. The value increasing along line $e_{s21}$ reaches $m_2$ at point $Q_{21}$ and is thereafter maintained at $m_2$ as shown by a horizontal line $e_{s22}$. Line $e_{s22}$ meets the lower limit line $D_2$ at point $Q_{22}$ and the value is thereafter given by a straight line $e_{s23}$ coinciding with line $D_2$.

The next step is set when the peak $P_2$ of value $e_m$ has fallen on any one of lines $e_{s21}$ to $e_{s23}$ at time $t_2$. There are established an upper limit line $D'_1$ and a lower limit $D'_2$ extending from peak $P_2$ defined by time $t_2$ and $m_2$ in parallel to the upper and lower limit lines $D_1$ and $D_2$, respectively. The set value after $t_2$ is given by a two dot chain line $e_{s31}$ coinciding with the upper limit line $D'_1$ until it increases by $\Delta m$ from $m_2$ to $m_3$. The value reaches $m_3$ at point $Q_{31}$ and is maintained at $m_3$ as shown by a horizontal line $e_{s32}$. The line $e_{s32}$ meets the lower limit line $D'_2$ at point $Q_{32}$ and the set value is thereafter given by a line $e_{s33}$ coinciding with the lower limit line $D'_2$. The foregoing steps are carried out by a control system and is repeated whenever the value $e_m$ has reached the set value, so that each peak of the value $e_m$ may be maintained within the range R until the consistency of the massecuite reaches the level $m_n$. The same procedure is repeated for establishing lines for the control of consistency in the next region.

According to the method shown in FIGS. 3A, 3B, all of the set values $e_s$ are defined in accordance with straight lines, i.e. two limit lines for each region which start from the peak. Thus, it is possible to program the set value of consistency at each level by a very simple algorithm.

Figure 4A:
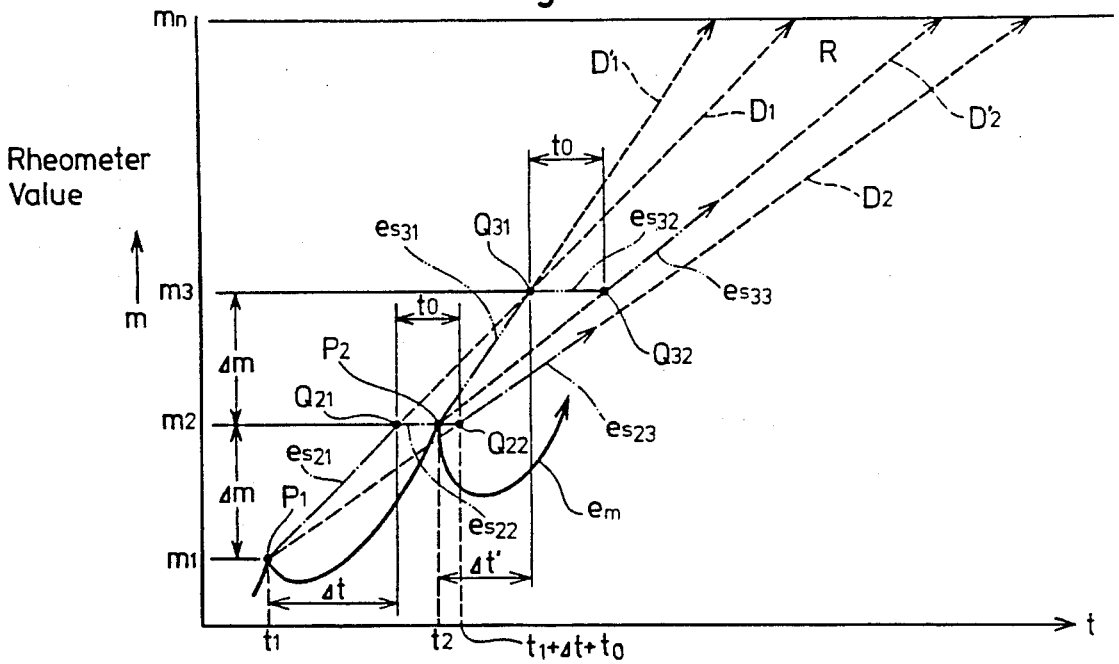
FIGS. 4A, 4B are graphical representations of a still further illustrative embodiment.
Figure 4B:
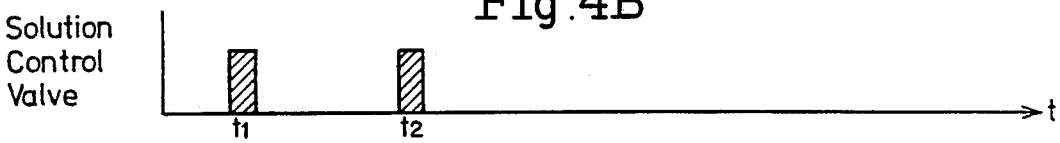

Another embodiment of the invention is shown in FIGS. 4A, 4B and is characterized by a still simpler algorithm. The area in which boiling is carried out is appropriately divided into a plurality of regions. The initial value of the massecuite consistency in a particular region is shown at $m_1$, and its final value at $m_n$, as is the case with the method shown in FIGS. 3A,3B. If the measured value of consistency reaches $m_1$ at time $t_1$, an upper limit curve or line $D_1$ is established as starting from peak $P_1$ defined by $t_1$ and $m_1$. The set value after time $t_1$ is given by a one dot chain line $e_{s21}$ coinciding with the upper limit curve or line $D_1$ until it increases by $\Delta m$ to $m_2$. The value reaches $m_2$ at point $Q_{21}$ and is thereafter maintained at $m_2$ as shown by a horizontal line $e_{s22}$. The length of time from $P_1$ to $Q_{21}$ is shown $\Delta t$.

According to a feature of the method shown in FIGS. 4A, 4B, the constant value represented by the horizontal line $e_{s22}$ is maintained for a specific length of time $t_0$. Thus, the time at which point $Q_{22}$ appears with the lapse of time $t_0$ after point $Q_{21}$ is expressed as $t_1+\Delta t+t_0$.

Another feature of the method shown in FIGS. 4A, 4B resides in the procedure for establishing the lower limit curves $D_2$, $D_2'$, . . . The first lower limit curve $D_1$ is defined by a straight line extending from point $P_1$ to $Q_{22}$ and has a gradient expressed as $\Delta m/(\Delta t+t_0)$. The line $e_{s23}$ is so established as to extend from the line as hereinabove defined.

The steps for the next cycle of operation is set so as to start at the peak $P_2$ which appears at time $t_2$ when the measured value $e_m$ of consistency falls on any one of lines $e_{s21}$ to $e_{s23}$. The steps for each further cycle are set in accordance with the upper and lower limit lines which are based on either a specific increment $\Delta m$ in consistency over the peak, or a specific length of time $\Delta t$ which has passed after the peak.

The method shown in FIGS. 4A, 4B is based on a specific increment $\Delta m$ in consistency. The consistency increases by $\Delta m$ from $m_2$ to $m_3$ at point $Q_{31}$ on the upper limit curve or line $D_1$ starting from peak $P_2$. The straight line $e_{s31}$ extending from $P_2$ to $Q_{31}$ defines the second upper limit line $D_1'$. The length of time required for the consistency to increase from $P_2$ to $Q_{31}$ is expressed as $\Delta t'$. The set value after point $Q_{31}$ is maintained constant for the same length of time $t_0$ along a horizontal line $e_{s32}$ as along the horizontal line $e_{s22}$. The line $e_{s32}$ meets point $Q_{32}$ the lower limit line $D_2'$ which is defined by a straight line extending from $P_2$ to $Q_{32}$. A line $e_{s33}$ extends from point $Q_{32}$.

In case the method is based on the lapse of a specific length of time $\Delta t$, point $Q_{31}$ appears on the upper limit curve or line $D_1$ with the lapse of time $\Delta t$ after peak $P_2$. In this case, the increase $\Delta m'$ in consistency from $m_2$ to $m_3$ is greater than $\Delta m$, and the upper limit line set for each cycle of operation is closer to $D_1$. Thus, it is possible to decrease the number of regions into which the entire process for boiling from the beginning of to the completion of crystallization, is divided. The horizontal and lower limit lines are established in the same way as when they are based on $\Delta m$.

According to the method shown in FIGS. 4A, 4B, it is possible to establish the upper and lower limit lines by a very simple algorithm, such as done in the method shown in FIGS. 3A, 3B.

Figure 5A:
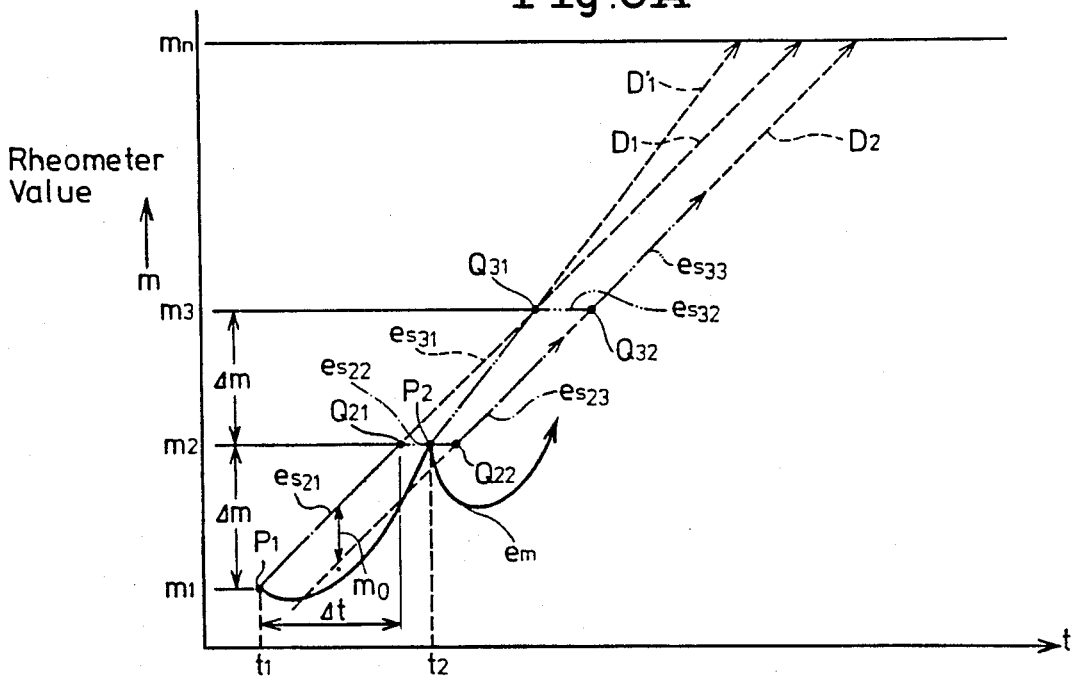
FIGS. 5A, 5B are graphical representations of another further illustrative embodiment.
Figure 5B:
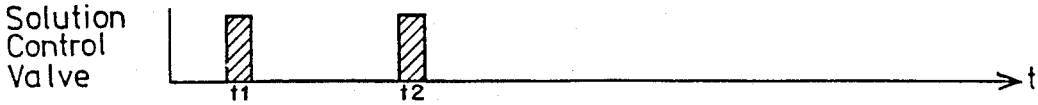

A still simpler procedure for establishing the lower limit line is shown in FIGS. 5A, 5B, with the procedure shown in FIGS. 4A, 4B being repeated for establishing of the upper limit line $D_1$.

The method of FIGS. 5A, 5B is characterized by a lower limit line which is defined by a straight line $D_2$ extending below line $D_1$ and representing a specific difference $m_0$ therefrom. While the lines $e_{s21}$, $e_{s22}$, and $e_{s23}$ starting from point $P_1$ and line $e_{s31}$, $e_{s32}$, and $e_{s33}$ starting from point $P_2$ are established in accordance with exactly the same procedure as those shown in FIGS. 4A, 4B, only the upper limit line is established as starting from each peak, and the lower limit line $D_2$ is not varied.

According to the method shown in FIGS. 5A, 5B, as well as that shown in FIGS. 4A, 4B, point $Q_{31}$ is that point on the upper limit curve or line $D_1$ at which the consistency $m_3$, which is $\Delta m$ higher than $m_2$ at point $P_2$, is obtained. It is, however, possible to select that point on $D_1$ which is reached with the lapse of time $\Delta t$ after $P_2$. In this case, if the consistency increases by $\Delta m'$ from $m_2$ to $m_3$, $\Delta m'$ is greater than $\Delta m$, and the upper limit line $D_1'$ is closer to $D_1$. Thus, is is possible to decrease the number of regions into which the entire boiling process from the beginning of to the completion of crystallization, is divided. The horizontal and lower limit lines are established in the same way, as is shown in FIGS. 5A, 5B.

According to the method shown inf FIGS. 5A, 5B, the lower limit line $D_2$, is finalized as initially defined and does not vary. Thus, it can be established by the still simpler algorithm.

Figure 6:
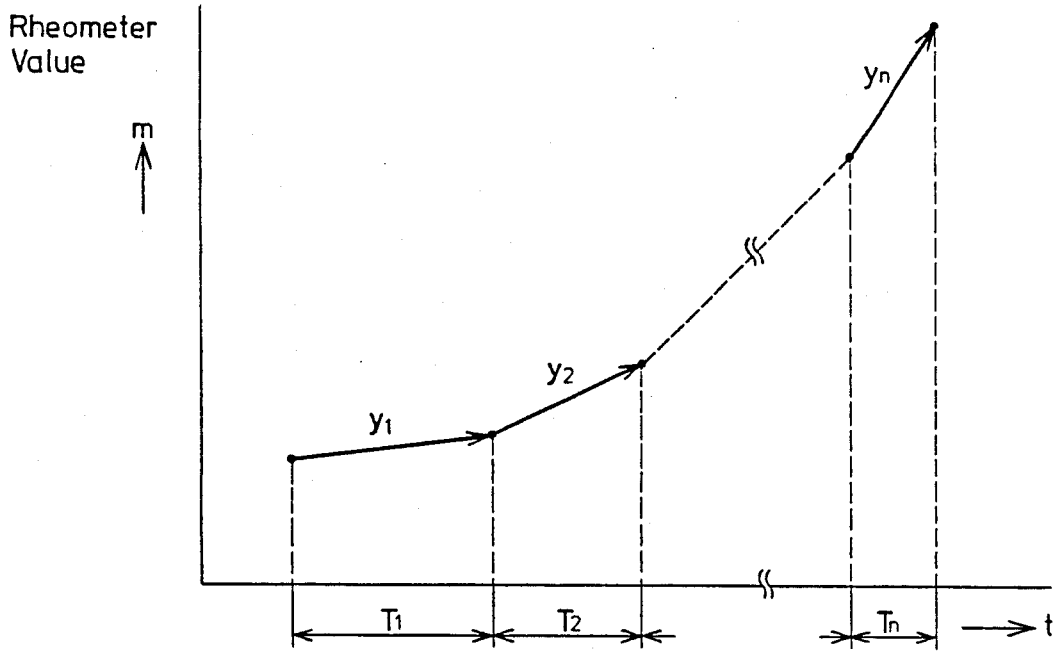
FIG. 6 is a graphical representation of a further embodiment.

While FIGS. 3A, 3B through 5A, 5B, have been described as showing methods for controlling consistency of massecuite, only in a particular portion of the boiling area, FIG. 6 shows a method of controlling the consistency over the entire boiling area or range which is divided into a plurality of regions $T_1$, $T_2$, . . . and $T_n$. As is apparent from FIG. 6, the upper limit curves or lines $y_1$ to $y_n$ for the regions $T_1$to $T_n$, respectively, are defined by a combination of curves or lines which gradually increase in gradient.

Advantageously, using the invention, it is possible to decrease drammatically the possibility of abnormal changes in boiling time and defective production that might otherwise result from substantial deviations from the upper and lower limit curves, of a curve joining the peak values of massecuite consistency. These deviations may occur in the event any variation has developed in any of the operating parameters, such as the amount of steam or pressure in the pan, or the purity of the solution, etc.

Should any disorder develope in any such parameters, it is often unavoidable to complete a particular batch of operation with consequent production of defective products, since even a highly experienced operator often finds it difficult to switch the setting of consistency from automatic to manual and to restore the correct limit curves. Advantageously, in the invention, the curves defining the set values of consistency are automatically corrected to as to fall within allowable ranges and thereby prevent any defective production, unless, of course, the disorder in the parameter is uncorrectable and fatal. Thus, a definite advance has been made by the invention. It is easy to carry out without requiring skilled personnel and without constant visual manual checking and observing of the pan contents by the personnel.

Moreover, advantageously, the invention can be carried out using a simplified procedure as shown in FIGS. 3A, 3B to 5A, 5B. The stability of opertion is ensured by a set of instructions to set two lines for each particular region. Since complex logic is not required, inexpensive apparatus may be used to carry out the invention. For example, the system of FIG. 1 may be used.

The foregoing description is illustrative of the principles of the invenition. Numerous modifications and extensions thereof would be apparent to the worker skilled in the art. All such modifications and extensions are to be considered to be within the spirit and scope of the invention.

What is claimed is:

1. A method of controlling the consistency of massecuite obtained from a first starting material having a specific number of solute molecules per unit volume in a batch process during automatic boiling in a pan using a rheometer for measuring the consistency, said method comprising the steps of boiling said massecuite in said pan;

measuring the consistency of said massacuite using said rheometer; and supplying water or syrup solution to said pan only when the consistency measured by said rheometer is between an ideal value of consistency and an allowable value of consistency, both said ideal value and said allowable value being determined by germ growth calculated using the following formula:

$$n_c = \sqrt{\frac{8m}{\pi kT}}\, x_c^2 N^2\, v\, Ac \left( \sqrt{\frac{2E_c}{m}} - C \right)$$

wherein $n_c$ is number of germs which grow in a unit time, m is mass of a solute molecule, $\pi$ is a constant, k is Boltzmann's constant, T is absolute temperature, $x_c$ is the distance between peak values of gravity between solute molecules $\bar{v}$ is the average velocity of movement of solute and solvent molecules, A is a constant of about 0.4, C is the upper limit of speed at which molecules are caught by crystals, and $E_c$ is the gravity at distance $x_c$ in the interaction of grains; and wherein for calculating said ideal value of consistency, N is said specific number of solute molecules per unit of said first starting material; and wherein for calculating said allowable value of consistency, N is the number of solute molecules per unit volume of a second starting material having massecuite of an acceptable lesser purity and being smaller than said specific number of said first starting material.

2. The method of claim 1, wherein the supplying of said water or said syrup solution to the pan is repeated two or more times.

* * * * *